US010843025B2

(12) United States Patent
Wilt et al.

(10) Patent No.: US 10,843,025 B2
(45) Date of Patent: Nov. 24, 2020

(54) NEGATIVE TILTING SQUAT MACHINE

(71) Applicant: C&M Machines LLC, Rock Hill, SC (US)

(72) Inventors: William B. Wilt, Tega Cay, SC (US); Charles Brewer, York, SC (US)

(73) Assignee: C&M MACHINES LLC, Rock Hill, SC (US)

( * ) Notice: Subject to any disclaimer, the term of this patent is extended or adjusted under 35 U.S.C. 154(b) by 9 days.

(21) Appl. No.: 16/391,211

(22) Filed: Apr. 22, 2019

(65) Prior Publication Data

US 2019/0321675 A1 Oct. 24, 2019

Related U.S. Application Data

(60) Provisional application No. 62/661,115, filed on Apr. 23, 2018.

(51) Int. Cl.
*A63B 21/005* (2006.01)
*A63B 23/035* (2006.01)
(Continued)

(52) U.S. Cl.
CPC ..... *A63B 21/0058* (2013.01); *A63B 21/4034* (2015.10); *A63B 21/4039* (2015.10);
(Continued)

(58) Field of Classification Search
CPC ..... A63B 21/00058; A63B 21/00069; A63B 21/00072; A63B 21/00076; A63B 21/00178; A63B 21/00181; A63B 21/005; A63B 21/0058; A63B 21/008; A63B 21/0083; A63B 21/0085; A63B 21/0087; A63B 21/15; A63B 21/158; A63B 21/159; A63B 21/4027; A63B 21/4033; A63B 21/4034; A63B 21/4035; A63B 21/4039; A63B 21/4045; A63B 23/035; A63B 23/03516; A63B 23/03525; A63B 23/04; A63B 23/0405; A63B 23/0482;
(Continued)

(56) References Cited

U.S. PATENT DOCUMENTS 3,866,914 A * 2/1975 Jackson ..... A63B 21/0628 473/438
4,333,644 A * 6/1982 Lambert, Jr. ..... A63B 21/06 482/101

(Continued)

*Primary Examiner* — Gary D Urbiel Goldner
(74) *Attorney, Agent, or Firm* — Jeffrey C. Watson; Mathew L. Grell; Grell & Watson Patent Attorneys LLC

(57) ABSTRACT

A negative tilting squat machine includes a base, a squat apparatus, and a linear angle actuator. The squat apparatus is pivotally mounted on the base. The squat apparatus includes a center post with a squatting device configured to slide thereon and allow the user to face the center post during exercise. A resistance actuator is configured to produce a force against the squatting device. Handles, shoulder pads, or a combination thereof are attached to the squatting device to provide the force produced from the resistance actuator against the squatting device to hands of the user gripping the handles, shoulders of the user pressing on the shoulder pads, or a combination thereof. A linear angle actuator is configured to adjust a squat angle between the base and the squat apparatus.

20 Claims, 12 Drawing Sheets

(51) Int. Cl.
*A63B 21/00* (2006.01)
*A63B 23/04* (2006.01)

(52) U.S. Cl.
CPC .... *A63B 21/4045* (2015.10); *A63B 23/03525* (2013.01); *A63B 23/0405* (2013.01); *A63B 2023/0411* (2013.01); *A63B 2225/09* (2013.01)

(58) Field of Classification Search
CPC ..... A63B 2023/0411; A63B 24/0062; A63B 24/0075; A63B 24/0087; A63B 2024/009; A63B 2024/0093; A63B 71/0054; A63B 71/0619; A63B 71/0622; A63B 2071/0063; A63B 2071/0072; A63B 2071/0081; A63B 2071/009; A63B 2071/065; A63B 2071/0658; A63B 2071/0675; A63B 2208/0204; A63B 2225/09; A63B 2225/093; A63B 2244/09
See application file for complete search history.

(56) References Cited

U.S. PATENT DOCUMENTS 4,357,010 A * 11/1982 Telle ..... A63B 21/00072 482/113
5,056,777 A * 10/1991 Capjon ..... A63B 21/0628 482/101
5,263,913 A * 11/1993 Boren ..... A63B 21/068 482/132
5,529,558 A * 6/1996 Koenig ..... A63B 21/0615 482/137
5,688,216 A * 11/1997 Mauriello ..... A63B 21/154 482/101
6,312,365 B1 * 11/2001 Koenig ..... A63B 21/0615 482/93
6,361,481 B1 * 3/2002 Koenig ..... A63B 21/06 482/93
6,981,934 B1 * 1/2006 Shifferaw ..... A63B 21/055 482/121
10,343,008 B2 * 7/2019 Pullins ..... A63B 23/0405
2004/0023760 A1 * 2/2004 Cockrill, Jr. ..... A63B 21/0626 482/93
2005/0119591 A1 * 6/2005 Vardy ..... A63B 21/008 600/587
2012/0058866 A1 * 3/2012 Hongo ..... A63B 23/03591 482/131
2012/0238418 A1 * 9/2012 Reyes ..... A63B 21/0615 482/121
2015/0111708 A1 * 4/2015 Smith ..... A63B 21/4033 482/98
2015/0375045 A1 * 12/2015 Ojanen ..... A63B 21/008 482/5
2016/0107024 A1 * 4/2016 Campanaro ..... A63B 22/0089 482/130
2018/0000680 A1 * 1/2018 Kelly ..... A63B 21/0624
2018/0104526 A1 * 4/2018 Kelly ..... A63B 21/4041

* cited by examiner

NEGATIVE TILTING SQUAT MACHINE

CROSS-REFERENCE TO RELATED APPLICATIONS

This application claims benefit of priority application, U.S. Provisional Ser. No. 62/661,115 filed Apr. 23, 2018 entitled "Negative Tilting Squat Machine", which is incorporated herein by reference in its entirety.

FIELD OF THE DISCLOSURE

The present disclosure is directed to exercise equipment or an exercise machine. More specifically, the instant disclosure is directed to a negative tilting squat machine that provides a means to perform squats or squatting type exercises at various angles, like in a football stance.

BACKGROUND

Generally speaking, in the exercise equipment industry there have been many innovative strength training devices made and sold. The most successful pieces of equipment are those that produce a functional strength for a task or occupation. In the NFL most football games are won by the ability of the offensive and defensive line to penetrate and make gaps allowing for a run play or time to make a downfield pass. The initial explosive power from the three or four point stance is created from the quadriceps, glutes, and hamstrings. The current methods of enhancing the power of such movements are using squats, power cleans, sleds, leg press, leg curls etc. These exercises allow the user to increase size and strength of the foundation muscles used to produce the strength or the power of these muscles, like the power needed for the offensive and defensive line. However, they do not train the strength of the user functionally for explosive power coming from a crouched lineman position.

The instant disclosure recognizes that it may be the player who can produce the most initial force that will move the other player in the desired direction. Although devices such as the sled or parachute provide resistance at various angles, they provide more of an endurance increase than an explosive force increase. Therefore, a need clearly exists for exercise equipment or an exercise machine that may allow the user to train or perform resistance squats from various angles.

The instant disclosure may be designed to address at least certain aspects of the problems or needs discussed above by providing the disclosed negative tilting squat machine.

SUMMARY

In accordance with at least select embodiments, the instant disclosure may address at least certain aspects of the above mentioned needs, issues and/or problems and may provide a negative tilting squat machine. Accordingly, in one aspect, the present disclosure may generally embrace a negative tilting squat machine that includes a base, a squat apparatus, and a linear angle actuator. The squat apparatus may be pivotally mounted on the base. The squat apparatus may include a center post with a squatting device. The squatting device may be configured to slide on the center post and allow the user to face the center post during exercise. A resistance actuator may be configured to produce a force against the squatting device on the center post mounted on the squat apparatus. A set of handles, a set of shoulder pads, or a combination thereof may be attached to the squatting device and configured to slide on the center post and provide the force produced from the resistance actuator against the squatting device to hands of the user gripping the set of handles, shoulders of the user pressing on the set of shoulder pads, or a combination thereof. A linear angle actuator may be configured to adjust a squat angle between the base and the squat apparatus pivotally mounted on the base.

One feature of the disclosed negative tilting squat machine may be that it can be configured to allow transmission of the force from the resistance actuator to the user via the squatting device sliding on the center post. This configuration may allow the user to activate the posterior chain, where an operative angle of transmission of the force can be adjusted via adjustment of the squat angle between the base and the squat apparatus pivotally mounted on the base. As a specific example, and clearly not limited thereto, the negative tilting squat machine may be configured to allow the user to achieve a football like stance during use, or other similar stance or position.

In select embodiments of the negative tilting squat machine, the resistance actuator may include a ball screw. The ball screw may be connected to the squatting device. The ball screw may be powered by an electric motor, like a servo motor, for moving the squatting device along the center post. In select embodiments, the force provided by the ball screw powered by the electric motor of the resistance actuator may be controlled by velocity, which may provide an unlimited force output. In other select embodiments, the force provided by the ball screw powered by the electric motor of the resistance actuator may be configured to match a force, or a force and velocity combination. In select embodiments, the ball screw powered by the electric motor may include a load cell attached thereto. The load cell may be configured to provide force feedback to the user of an applied force. In select embodiments, the load cell may be attached to the ball screw and squatting device via a mounting bracket configured to allow the load cell to directly read the applied force in both directions. In other select embodiments, the torque or amperage feedback from the servo motor may be used to derive the force output from the user. In other select embodiments, the ball screw powered by the electric motor may include an adjustable stroke configurable to match a range of motion of the user. The adjustable stroke may include an adjustable starting point, where the set of handles, the set of shoulder pads, or the combination thereof are configured to adjust to a height of the user.

In select embodiments of the negative tilting squat machine, the center post may include a tubular center structure. The tubular center structure may be mounted to the base by a single pivot point configured to allow for adjustment of the squat angle between the base and the squat apparatus. In select embodiments, the tubular center structure may include a c-channel beam mounted on a front side of the tubular center structure. The c-channel beam may be configured to provide a flat mounting surface configured for mounting the squat apparatus to the tubular center structure. One feature of this configuration may be that the squatting device of the squat apparatus may be mounted to the c-channel beam via a linear bearing assembly mounted to a sub-carriage configured to support the squatting device. The sub-carriage with the linear bearing assembly may be configured to slide on a track mounted on the c-channel beam. One feature of the linear bearing assembly may be that it can be configured to remove non-linear forces from the resistance actuator of the squat apparatus.

One feature of the linear angle actuator of the negative tilting squat machine may be that it can be configured to allow the user to adjust the squat angle between the base and the squat apparatus pivotally mounted on the base from a vertical angle, or approximately vertical, to a horizontal angle. The horizontal angle may be, but is not limited to, being approximately twenty degrees from horizontal.

Another feature of the linear angle actuator of the negative tilting squat machine may be that the linear angle actuator can be configured to allow the user to adjust the squat angle to a fixed squat angle prior to exercise movements.

Another feature of the linear angle actuator of the negative tilting squat machine may be that the linear angle actuator can be configured to adjust the squat angle freely during exercise movements.

Another feature of the linear angle actuator of the negative tilting squat machine may be that the linear angle actuator can be configured to adjust the squat angle at set intervals during exercise movements.

One feature of the negative tilting squat machine may be that the base can include a platform. The platform may be configured to support a user standing thereon during use of the negative tilting squat machine. In select embodiments, the platform may include a tilting foot board. The tilting food board may include a hinged front side configured to raise a back side of the tilting foot board. Wherein, when the tilting foot board is hinged up to raise the back side, the hinged up tilting foot board may provide foot support or grip for the user. In select embodiments, the tilting foot board may include a linear foot actuator configured to control the hinging of the tilting foot board. The base may include a substructure beneath the platform for supporting the platform. The substructure may also provide a connection point for the single pivot point of the squat apparatus on the base. In select embodiments, the substructure may include a plurality of I-beams around the perimeter of the platform.

Another feature of the disclosed negative tilting squat machine may be that the base can include a protruding I-beam. The protruding I-beam may protrude from the platform below the squat apparatus. The protruding I-beam may be configured to prevent the negative tilting squat machine from tipping over during operation. The protruding I-beam may include a rotatable attachment point for the linear angle actuator configured to adjust the squat angle between the protruding I-beam and the squat apparatus pivotally mounted on the base.

In select embodiments of the negative tilting squat machine, the squat apparatus may include a curved chest pad. The curved chest pad may be configured to provide support to the user while forcing the user to use core muscles to stabilize their movement.

In select embodiments of the negative tilting squat machine, the squat apparatus may include a curved leg pad. The curved leg pad may be configured to allow the user to safely and comfortably position their legs on each side of the center post.

Another feature of the disclosed negative tilting squat machine may be that the set of shoulder pads may be configured to rotate, slide laterally, or a combination thereof, to accommodate the shoulders of the user.

In select embodiments, the negative tilting squat machine may include a processor. The processor may be configured to control the force provided by the resistance actuator and a range of motion of the squatting device. The processor may also be configured to control the linear angle actuator and/or the linear foot actuator for controlling the squat angle and/or the tilting foot board.

In select embodiments, the negative tilting squat machine may include a display. The display may be configured to provide graphics and force feedback to the user of an applied force. In select embodiments, the display may include a graphical user interface that allows the user to customize a workout. As examples, and clearly not limited thereto, the graphical user interface may allow the user to customize their workout by: repetition quantity; repetition speed (which can be configured to be varied during the exercise by the user, with up/down speed independently) or duration; constant force or maximum force output configured to vary the speed to keep the force constant, or maintain a constant speed regardless of force applied; stroke length; varying the squat angle automatically during the exercise; or any various combinations thereof.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1:
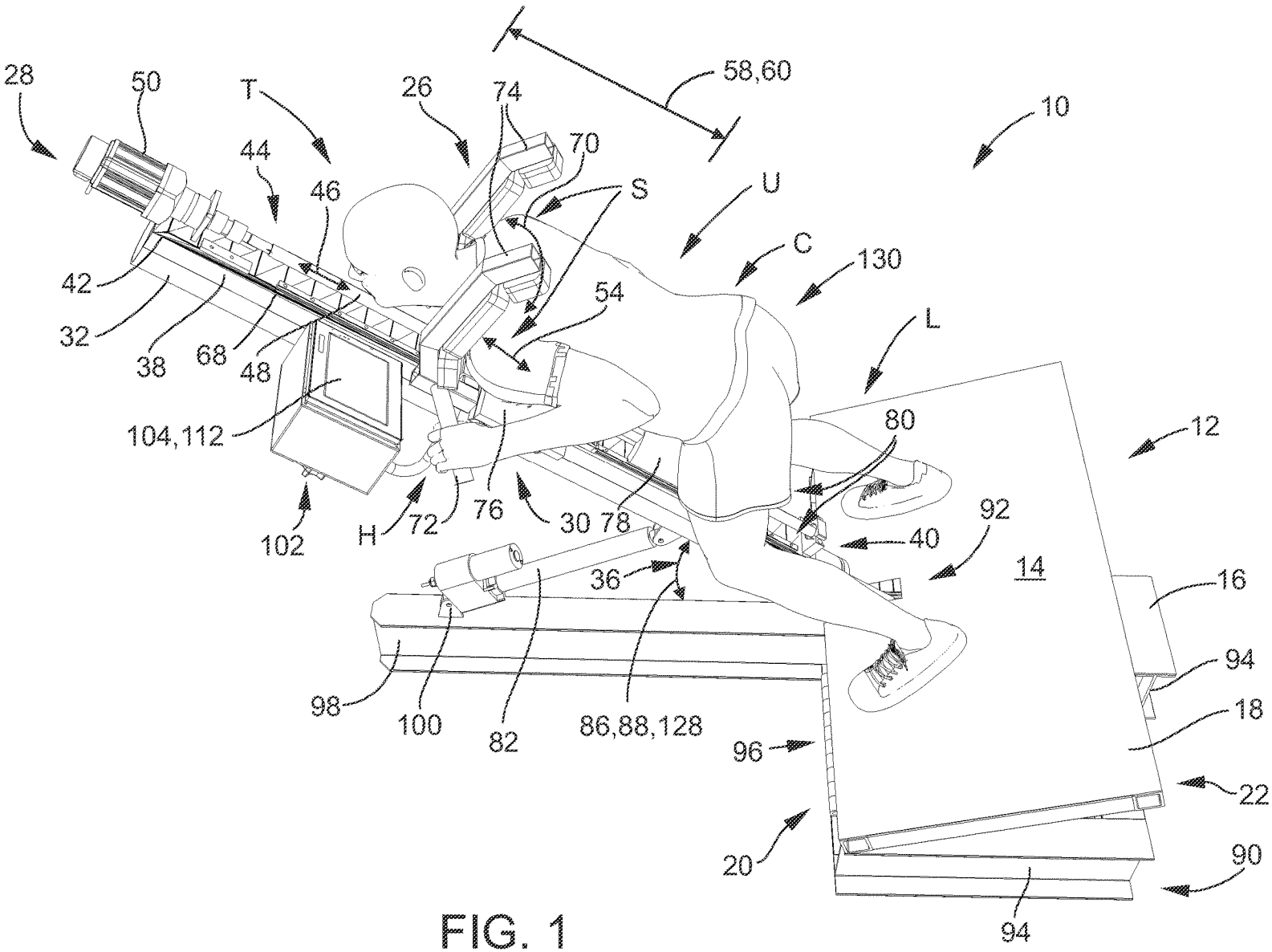
FIG. 1 illustrates a side perspective view of the negative tilting squat machine according to select embodiments of the instant disclosure with a user performing a squat at a lowered horizontal angle, like in a football stance, with the hinged foot board raised for foot support and/or traction.
Figure 2:
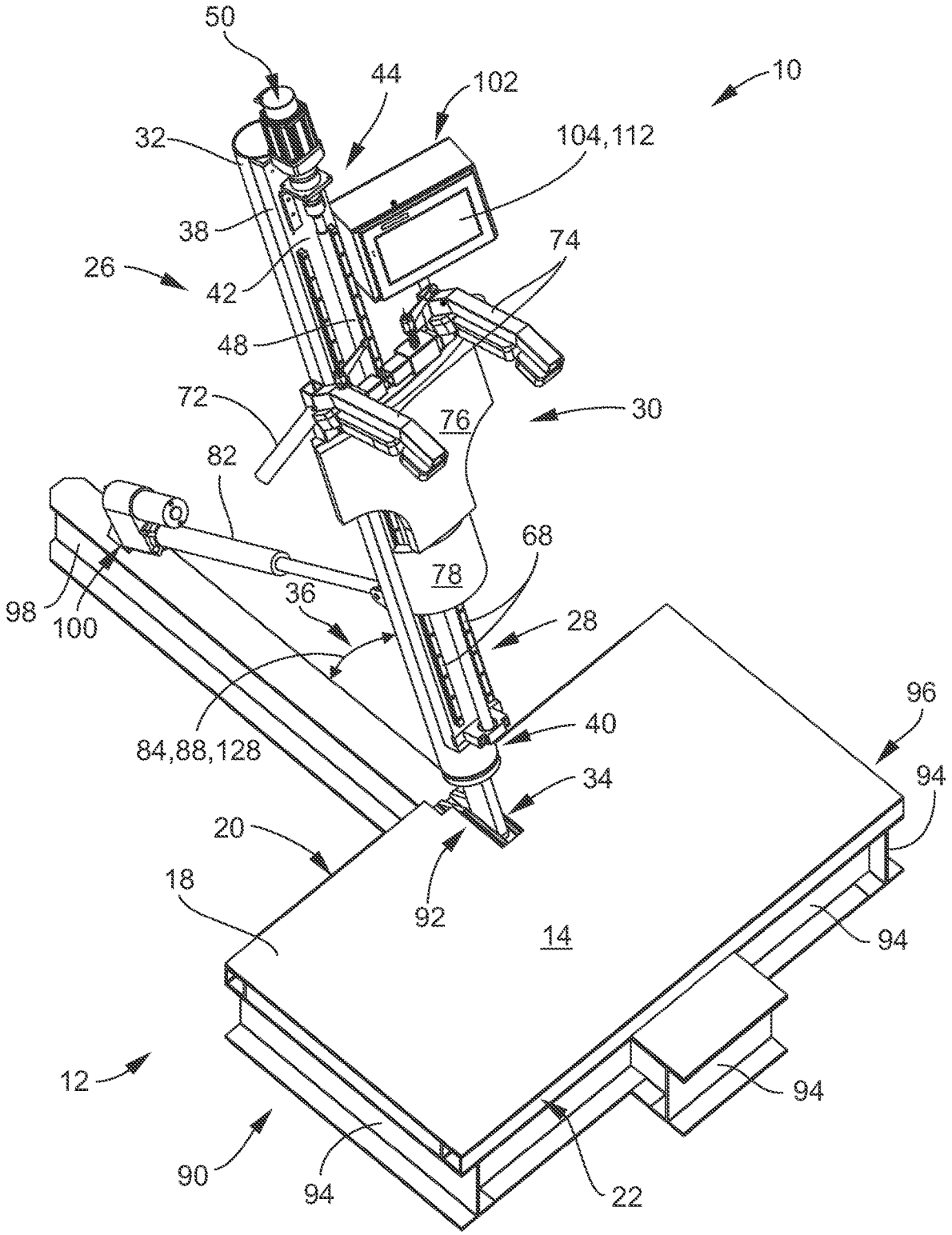
FIG. 2 illustrates a front perspective view of the negative tiling squat machine of FIG. 1 in a raised almost vertical angle position.
Figure 3:
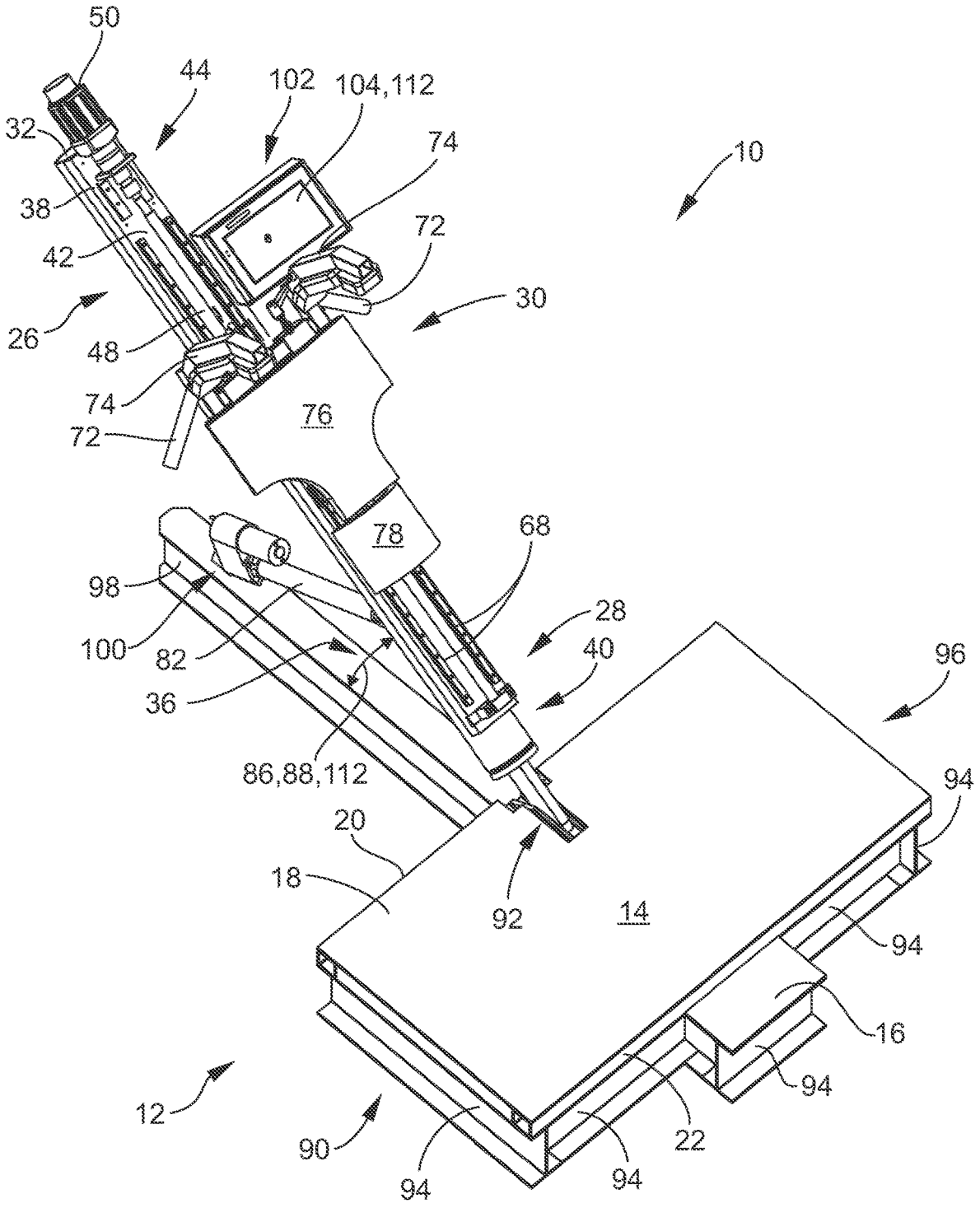
FIG. 3 illustrates a front perspective view of the negative tilting squat machine of FIG. 1 in a lowered horizontal angle position.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-11, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring now to FIGS. 1-11, in a possibly preferred embodiment, the present disclosure overcomes the above-mentioned disadvantages and meets the recognized need for such an apparatus or method by providing of negative tilting squat machine 10. Negative tilting squat machine 10 may be for providing a machine or device designed for allowing user U to perform squat type exercises at various operative angles 128. Negative tilting squat machine 10 may generally include base 12, squat apparatus 26 and linear angle actuator 82. These components and their functions are discussed in greater detail below.

Figure 4:
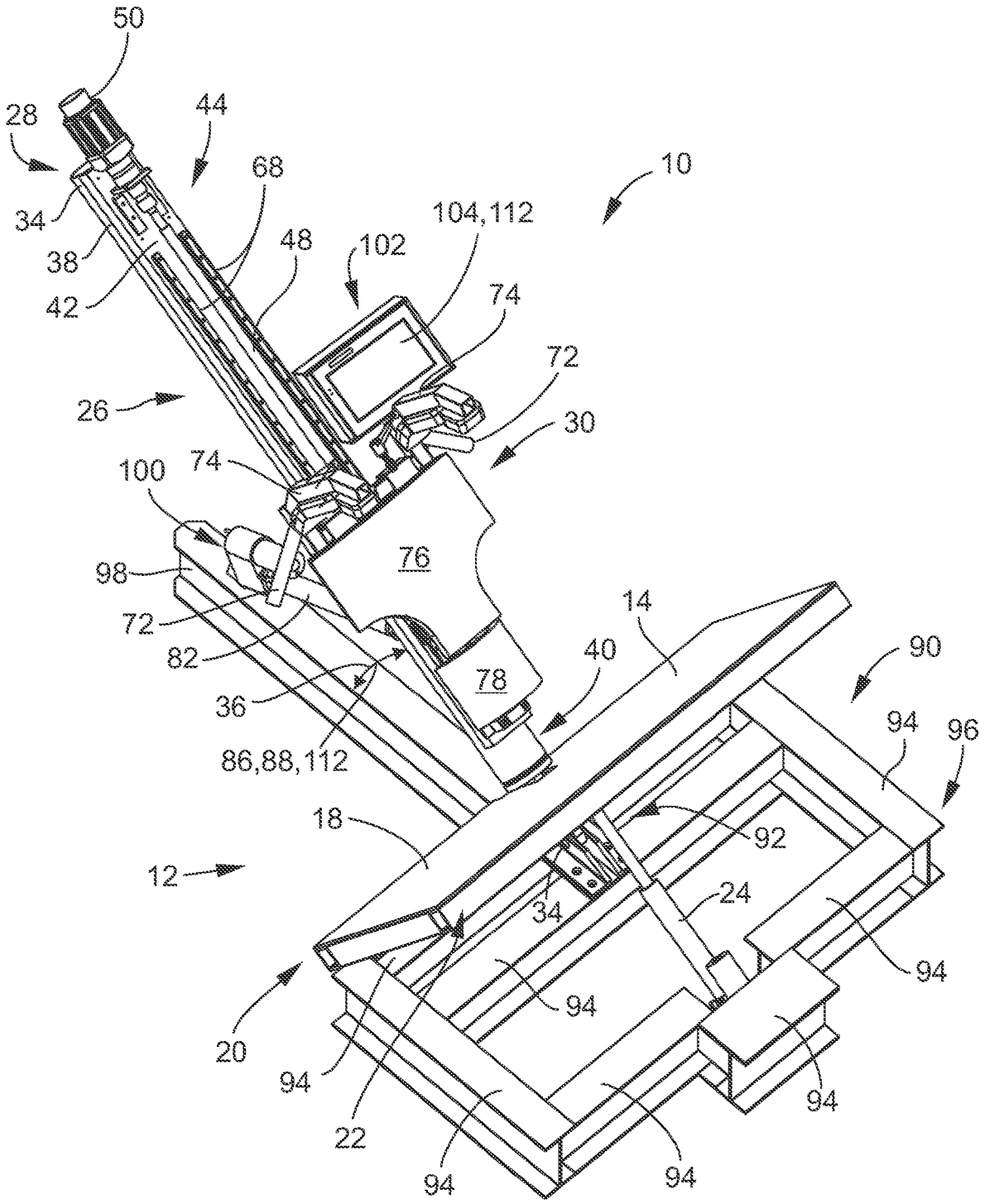
FIG. 4 illustrates a front perspective view of the negative tilting squat machine of FIG. 1 in a lowered horizontal angle position with the tilting foot board hinged up for foot support and/or traction.
Figure 5A:
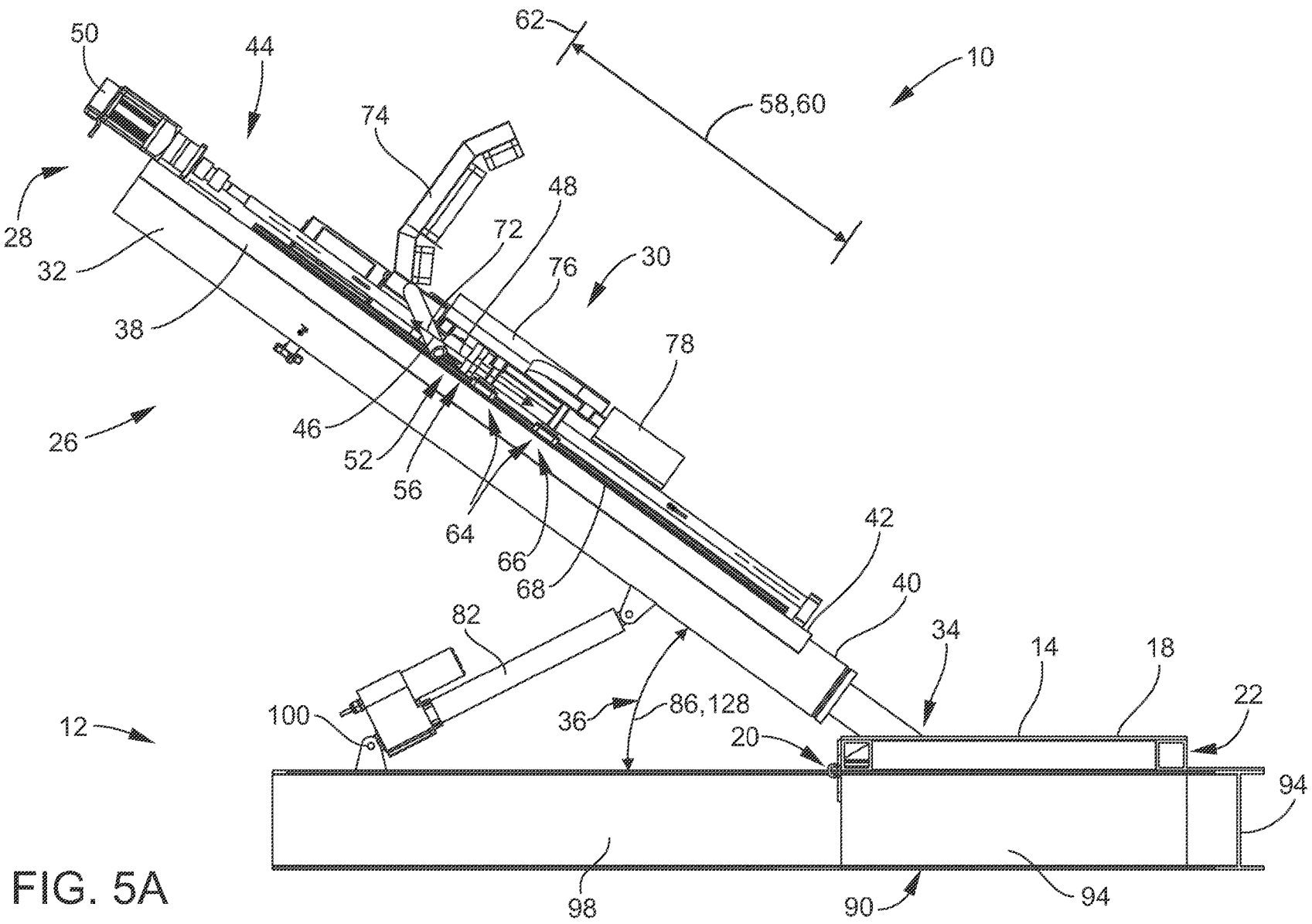
FIG. 5A illustrates a left side view of the negative tilting squat machine of FIG. 1 in a lowered horizontal angle position.
Figure 5B:
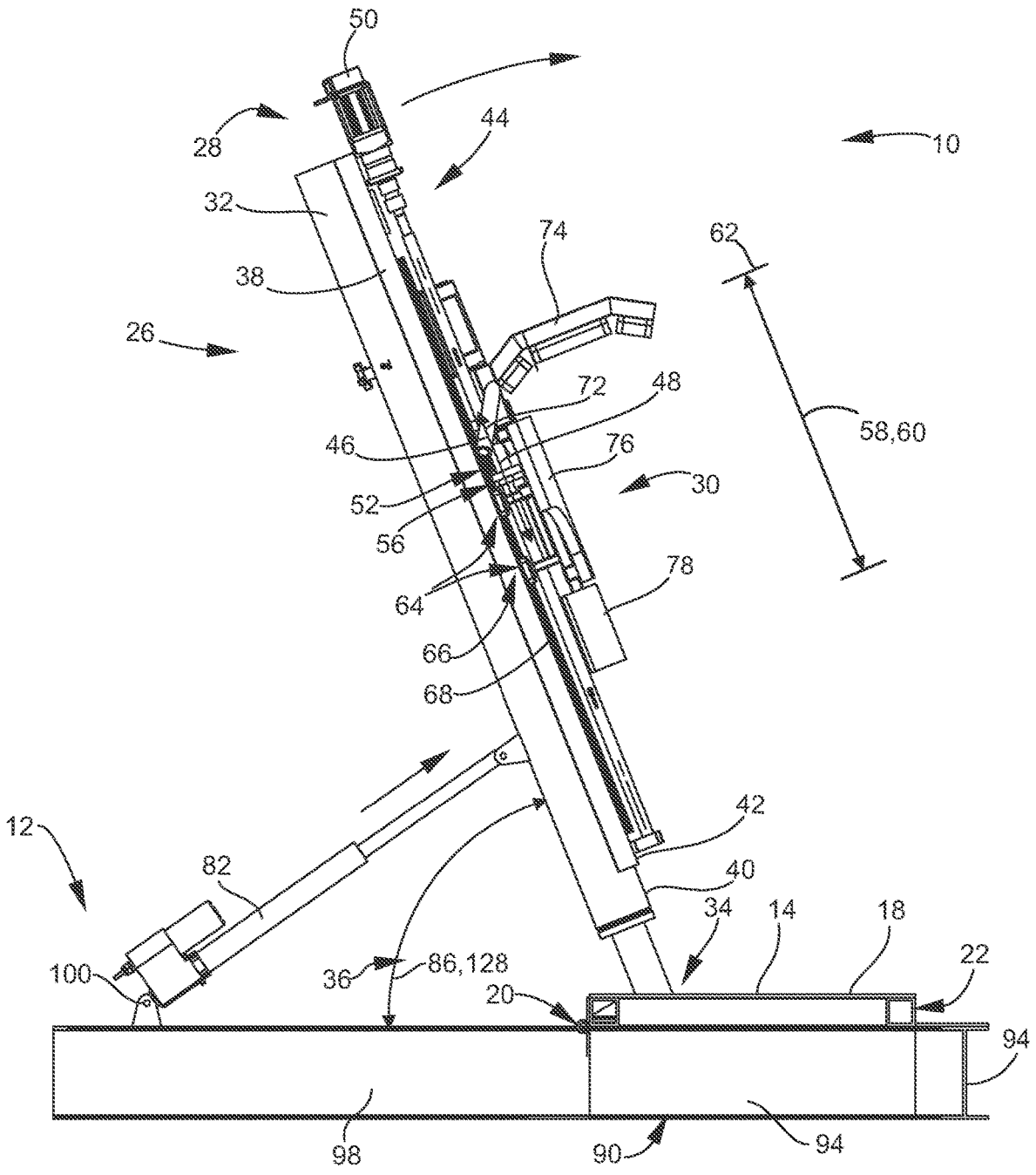
FIG. 5B illustrates a left side view of the negative tilting squat machine of FIG. 1 in a raised vertical angle position.
Figure 6:
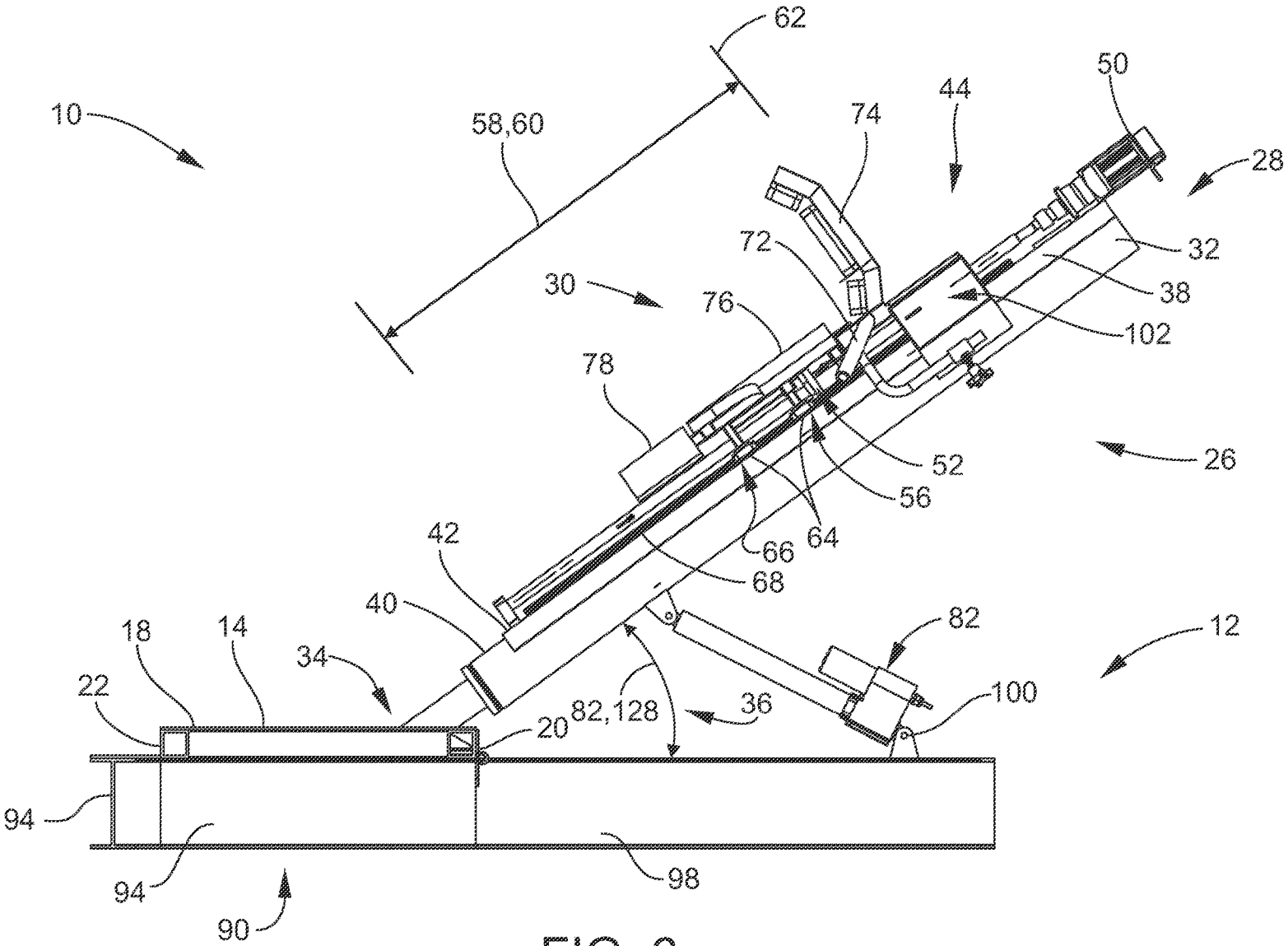
FIG. 6 illustrates a right side view of the negative tilting squat machine of FIG. 1 in a lowered horizontal angle position.
Figure 9:
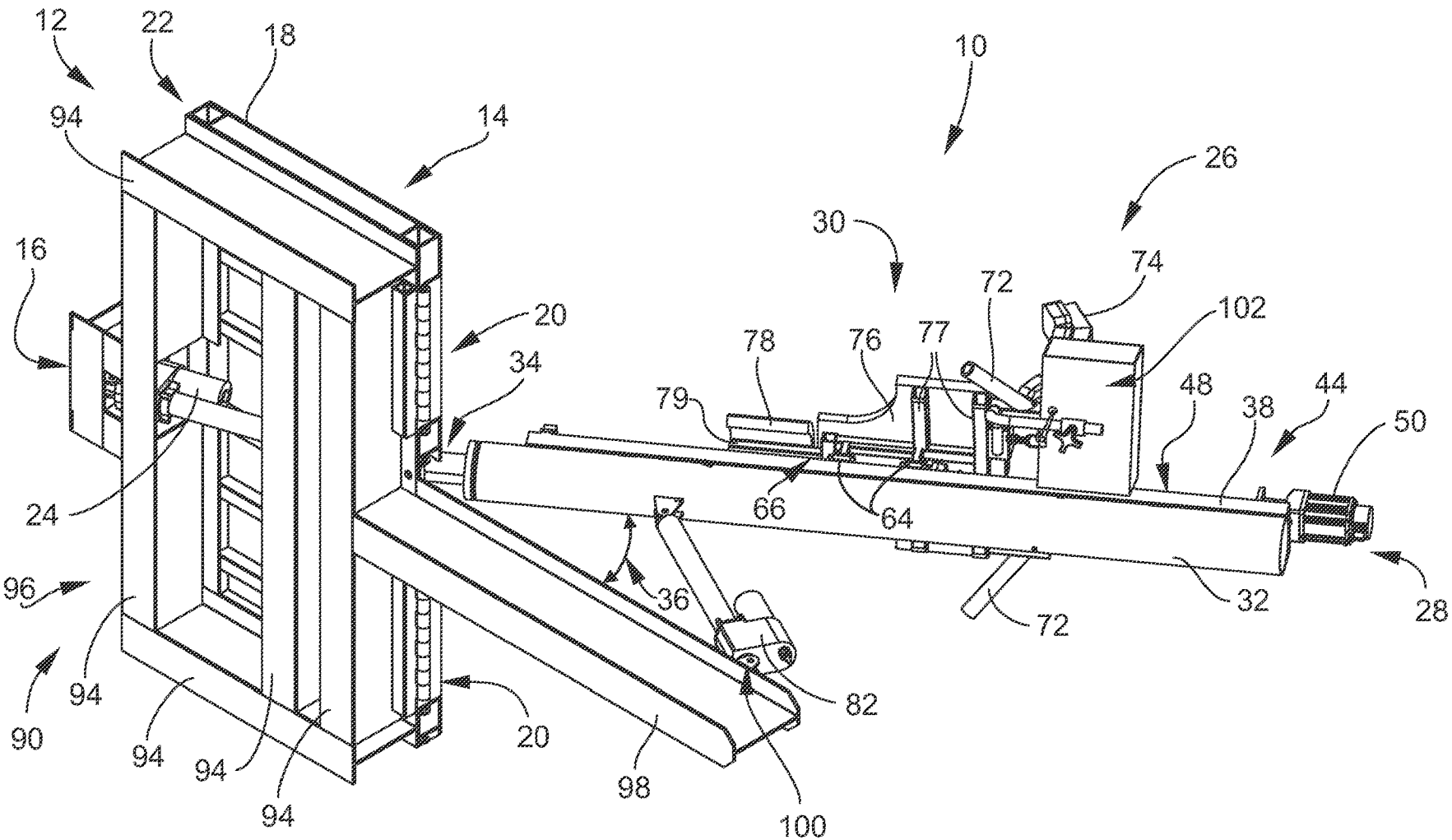
FIG. 9 illustrates a bottom perspective view of the negative tilting squat machine of FIG. 1 in a lowered horizontal angle position.
Figure 10:
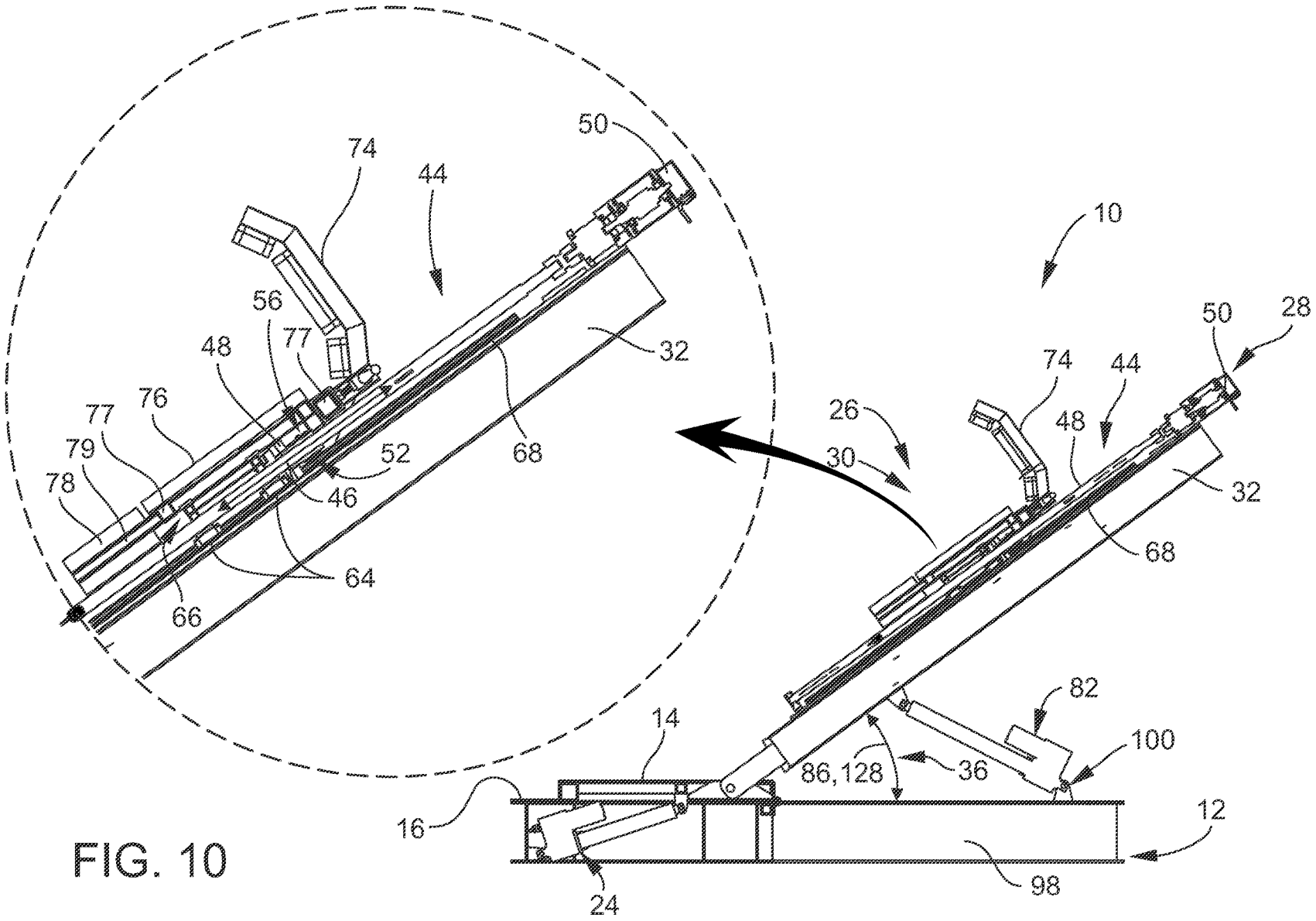
FIG. 10 illustrates a right side view of the negative tilting squat machine of FIG. 1 in a lowered horizontal angle position showing a zoomed in section of the squat apparatus.
Figure 11:
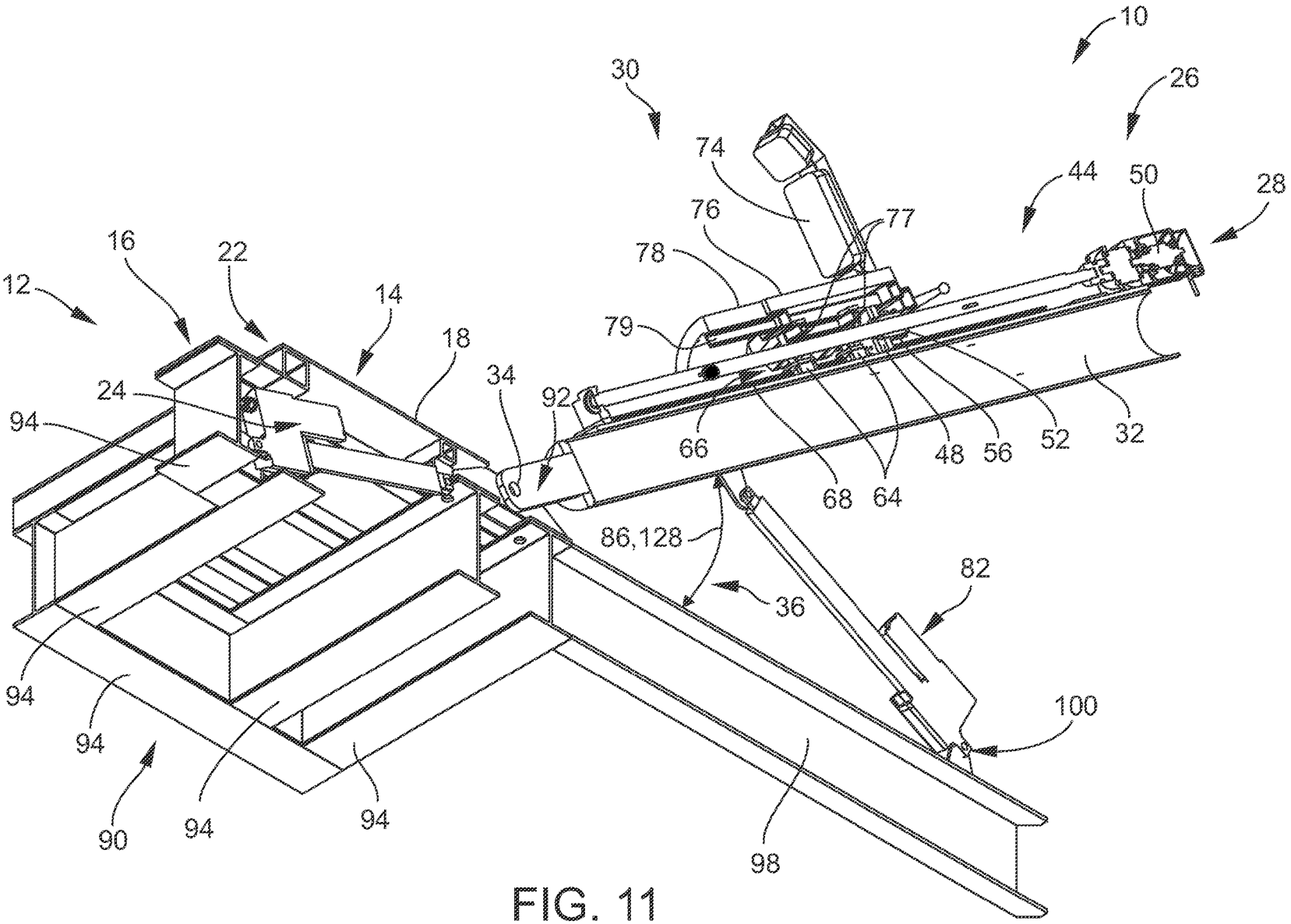
FIG. 11 illustrates a bottom perspective cross-sectional view through the middle of the negative tilting squat machine of FIG. 1 in a lowered angle position.

Base 12 may be included with negative tilting squat machine 10. Base 12 may be configured to support negative tilting squat machine 10 in operation. Base 12 may include any various components for members for supporting squat machine 10 in operation. Base 12 may include platform 14. Platform 14 may be configured to support user U standing thereon during use of negative tilting squat machine 10. Platform 14 may thus provide a surface on base 12 for user U to stand thereon during use of negative tilting squat machine 10. Platform 14 may be any various size and/or shape. In select embodiments, platform 14 may include step 16 for stepping onto platform 14, as shown in the figures. In select embodiments, as shown in the Figures, Platform 14 may include tilting foot board 18. Tilting foot board 18 may have hinged front side 20 configured to raise back side 22 of tilting foot board 18. Wherein, when tilting foot board 18 is hinged up to raise back side 22 (as shown in FIGS. 1, and 4), tilting foot board 18 may provide more foot support or grip for user U when performing movements at lowered horizontal angles 86. Tilting foot board 18 may include linear foot actuator 24. Best shown in FIGS. 4, 9, and 11). Linear foot actuator 24 may be configured to control the hinging of tilting foot board 18 of platform 14. Linear foot actuator 24 may be controlled by processor 102 through graphical user interface 112 on display 104. In select embodiments, as shown in the Figures, base 12 may include substructure 90. Substructure 90 may be beneath platform 13 for supporting platform 14 and providing connection point 92 for single pivot point 34 of squat apparatus 26 on base 12. Substructure 90 may include any components or members for supporting platform 14. Substructure 90, as shown in the Figures may include plurality of I-beams 94 around perimeter 96 of platform 14. In addition, another I-beam 94 may be included within perimeter 96 for supporting connection point 93 for single pivot point 34, as shown in FIGS. 4, 9 and 11. Furthermore, base 12 may include protruding I-beam 98. Protruding I-beam 98 may protrude from platform 14 below squat apparatus 26. Protruding I-beam 98 (or other structural member besides an I-beam) may be configured to prevent negative tilting squat machine 10 from tipping over during operation and thus provide stability to the machine. In addition, protruding I-beam 98 may include rotatable attachment point 100 for linear angle actuator 82 configured to adjust squat angle 36 between protruding I-beam 98 and squat apparatus 26 pivotally mounted on base 12.

Squat apparatus 26 may be included with negative tilting squat machine 10. Squat apparatus 26 may be the components on base 12 of negative tilting squat machine 10 that are used in performing exercises, like squats or the like. Squat apparatus 26 may be pivotally mounted on base 12. In select embodiments, squat apparatus 26 may be pivotally mounted on base 12 via single pivot point 34. Squat apparatus 26 may include center post 28. Center post 28 may be mounted to base 12 via single pivot point 34. Center post 28 may include squatting device 30 in operation thereon. Squatting device 30 may be configured to slide on center post 28. Squatting device 30 may be configured to allow user U to face center post 28 during exercise. Center post 28 may include tubular center structure 32 mounted to base 12 by single pivot point 34 configured to allow for adjustment of squat angle 36 between base 12 and squat apparatus 26. This feature of negative tilting squat machine 10 of providing adjustment of squat angle 36 is where the "tilting" portion of the name negative tilting squat machine 10 is derived from. In select embodiments, tubular center structure 32 may include c-channel beam 38. C-channel beam 38 may be mounted on front side 40 of tubular center structure 32. C-channel beam 38 may be configured to provide flat mounting surface 42. This flat mounting surface 42 may be configured for mounting squat apparatus 26 and its components to tubular center structure 32;

Resistance actuator 44 may be included with squat apparatus 26 of negative tilting squat machine 10. Resistance actuator 44 may be for providing the resistance or forces against user U for squatting exercises, or the like. Resistance actuator 44 may thus be configured to produce force 46 against squatting device 30 on center post 28 mounted on squat apparatus 26. Resistance actuator 44 may be any mechanism or device for providing resistance or force 46 to squatting device 30. In select embodiments, resistance actuator 44 may include ball screw 48. Ball screw 48 may be connected to squatting device 30 (best shown in FIGS. 5A, 5B, 6, 10 and 11) for providing force 46 against squatting device 30. Ball screw 48 may be powered by electric motor 50. Electric motor 50 may be any type or size of electric motor, including, but not limited to a servo motor, as shown in the figures. In select embodiments, a gearbox may be included to vary the ratio between electric motor 50 and ball screw 48. Electric motor 50 may be configured to power ball screw 48 for moving squatting device 30 up and down along center post 28. Whereby, in select embodiments, force 46 provided by ball screw 48 powered by electric motor 50 may be controlled by velocity. In other words, electric motor 50 may control the speed at which ball screw 48 moves squatting device 30 up and down along center post 28. As such, user U may put as much or as little force against squatting device 30 while performing squat exercise movements, or the like, at various speeds or velocities and in both directions (this feature of negative tilting squat machine 10 of providing resistance in both directions is where the term "negative" is derived from of the name negative tilting squat machine 10). Accordingly, the force output of resistance actuator 44 may be unlimited. In other select embodiments, force 46 provided by ball screw 48 powered by electric motor 50 of resistance actuator 44 may be configured to match a force, or a force and velocity combination.

In select embodiments, load cell 52 may be included with resistance actuator 44. See FIGS. 5A, 5B, 6, 10 and 11. Load cell 52 may be for reading applied forces 54 against squatting device 30 to resistance actuator 44. Wherein, ball screw 48 powered by electric motor 50 may include load cell 52 attached thereto. Load cell 52 may be configured to provide force feedback of applied force 54. Load cell 52 may be attached to ball screw 48 and squatting device 30 via mounting bracket 56. Mounting bracket 56 may be configured to allow load cell 52 to directly read applied forces 54 in both directions. Load cell 52 may communicate with processor 102, whereby applied forces 54 may be displayed on graphical user interface 112 of display 104. In other select embodiments, the torque or amperage feedback from electric motor 50, like a servo motor, may be used to derive the force output from user U. In other select embodiments, the velocity may be varied by a selectable force based on force feedback.

Squatting device 30 of squat apparatus 26 may be attached or mounted on center post 28 by many various means and mechanisms. As shown in the Figures, in select embodiments, squatting device 30 may be mounted to c-channel beam 38 via linear bearing assembly 64 (best shown in FIGS. 5A, 5B, 6, 10 and 11). Linear bearing assembly 64 may be mounted to sub-carriage 66 configured to support squatting device 30 and all of its components as it travels up and down on center post 28. Sub-carriage 66 with linear bearing assembly 64 may be configured to slide on track 68, or a plurality of tracks 68 mounted on c-channel beam 38. As shown in the Figures, in select embodiments two tracks 68 may be positioned on each side of ball screw 48, where linear bearing assembly 64 with sub-carriage 66 may be configured to slide up and down along center post 28 over top of ball screw 48. Wherein, linear bearing assembly 64 may be configured to remove non-linear forces 70 (shown in FIG. 1) from resistance actuator 44 of squat apparatus 26 (like ball screw 48).

Set of handles 72 may be included with squatting device 30 of squat apparatus 26 in negative tilting squat machine 10. Set of handles 72 may be positioned on both sides of squatting device 30 for each hand H of user U. Set of handles 72 may be positioned at various angles and may be provided in various shapes and lengths as desired. Set of handles 72 may be fixed in position or may rotate, pivot and/or extends to accommodate various hand locations for various size and shapes of users. Set of handles 72 may provide a means of transmitting forces 46 from resistance actuator 44 to user U during squatting exercise or the like on negative tilting squat machine 10. Set of handles 72 may be configured to move with squatting device 30 and slide on center post 28 and provide force 46 produced from resistance actuator 44 against squatting device 30 to hands H of user U gripping set of handles 72 during use of negative tilting squat machine 10.

Set of shoulder pads 74 may be included with squatting device 30 of squat apparatus 26 in negative tilting squat machine 10. Set of shoulder pads 74 may be positioned on both sides of squatting device 30 for each shoulder S of user U. Set of should pads 74 may be positioned at various angles and may be provided in various shapes and lengths as desired. Set of shoulder pads 74 may be fixed in position in select embodiments. In other select embodiments, as shown in the Figures, set of should pads 74 may rotate and/or slide laterally to accommodate various shoulder sizes and widths of various size and shapes of users. Set of shoulder pads 74 may provide a means of transmitting forces 76 from resistance actuator 44 to user U during squatting exercise or the like on negative tilting squat machine 10. Set of shoulder pads 74 may be configured to move with squatting device 30 and slide on center post 28 and provide force 46 produced from resistance actuator 44 against squatting device 30 to shoulders S of user U pressing up against set of shoulder pads 74 during use of negative tilting squat machine 10.

As shown in the Figures, in select embodiments a combination of bot set of handles 72 and set of shoulder pads 74 may be includes with squatting device 30 of squat apparatus 26 in negative tilting squat machine 10. This combination of set of handles 72 and set of shoulder pads 74 may be configured to move with squatting device 30 and slide on center post 28 and provide force 46 produced from resistance actuator 44 against squatting device 30 to hands H of user U gripping set of handles 72 and shoulders S of user U pressing on set of shoulder pads 74.

As shown in FIG. 1, squatting device 30 of negative tilting squat machine 10 may include adjustable stroke 58. Adjustable stroke 58 may be configured to match range of motion 60 user U. In select embodiments, adjustable stroke 58 may include adjustable starting point 62. Adjustable starting point 62 may be positioned and located where set of handles 72, set of shoulder pads 74, or the combination thereof are configured to adjust to height T of user U; Adjustable stroke 58 and adjustable starting point 62 may be controlled by processor 102 via graphical user interface on display 104.

Figure 7:
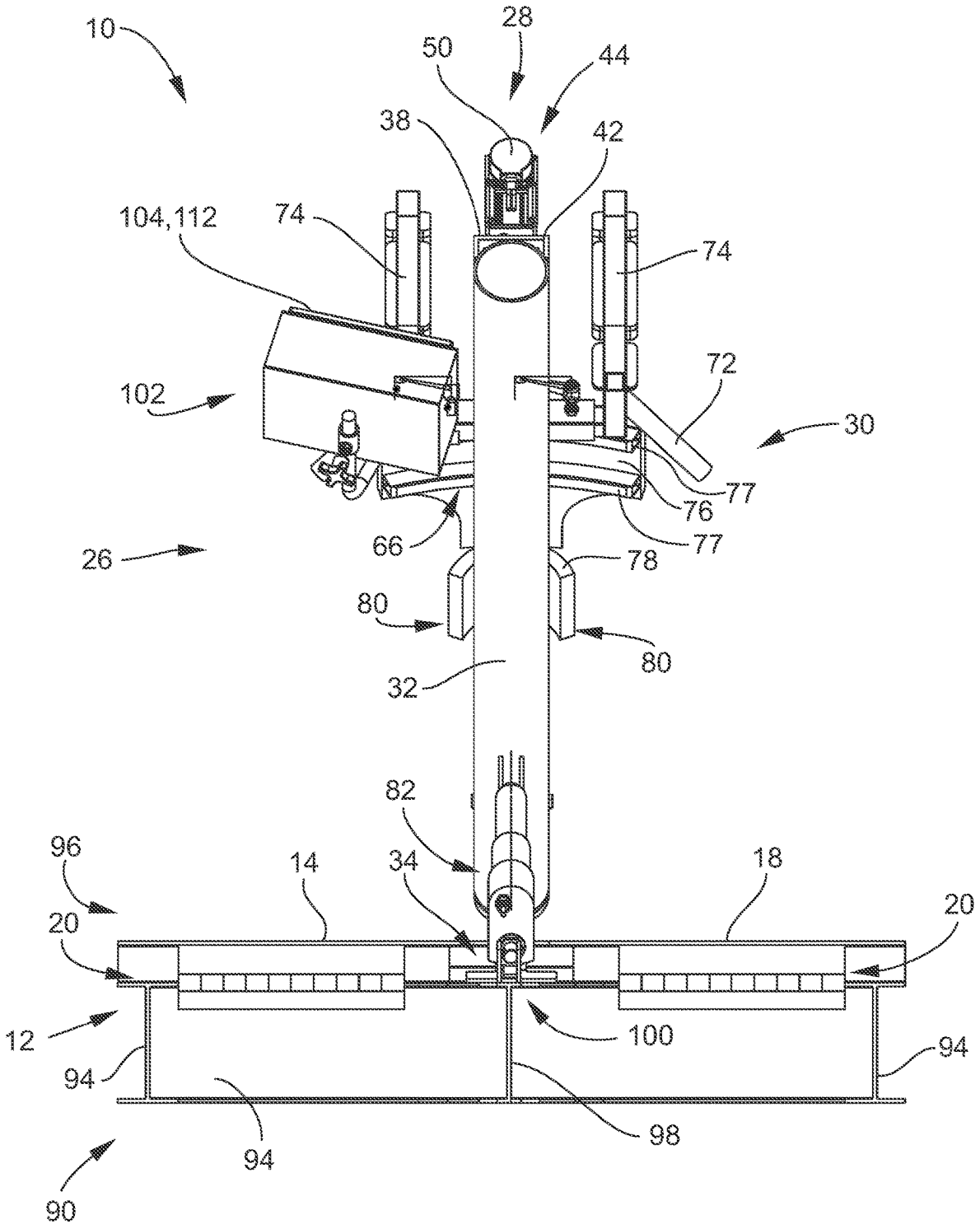
FIG. 7 illustrates a rear view of the negative tilting squat machine of FIG. 1 in a lowered horizontal angle position.
Figure 8:
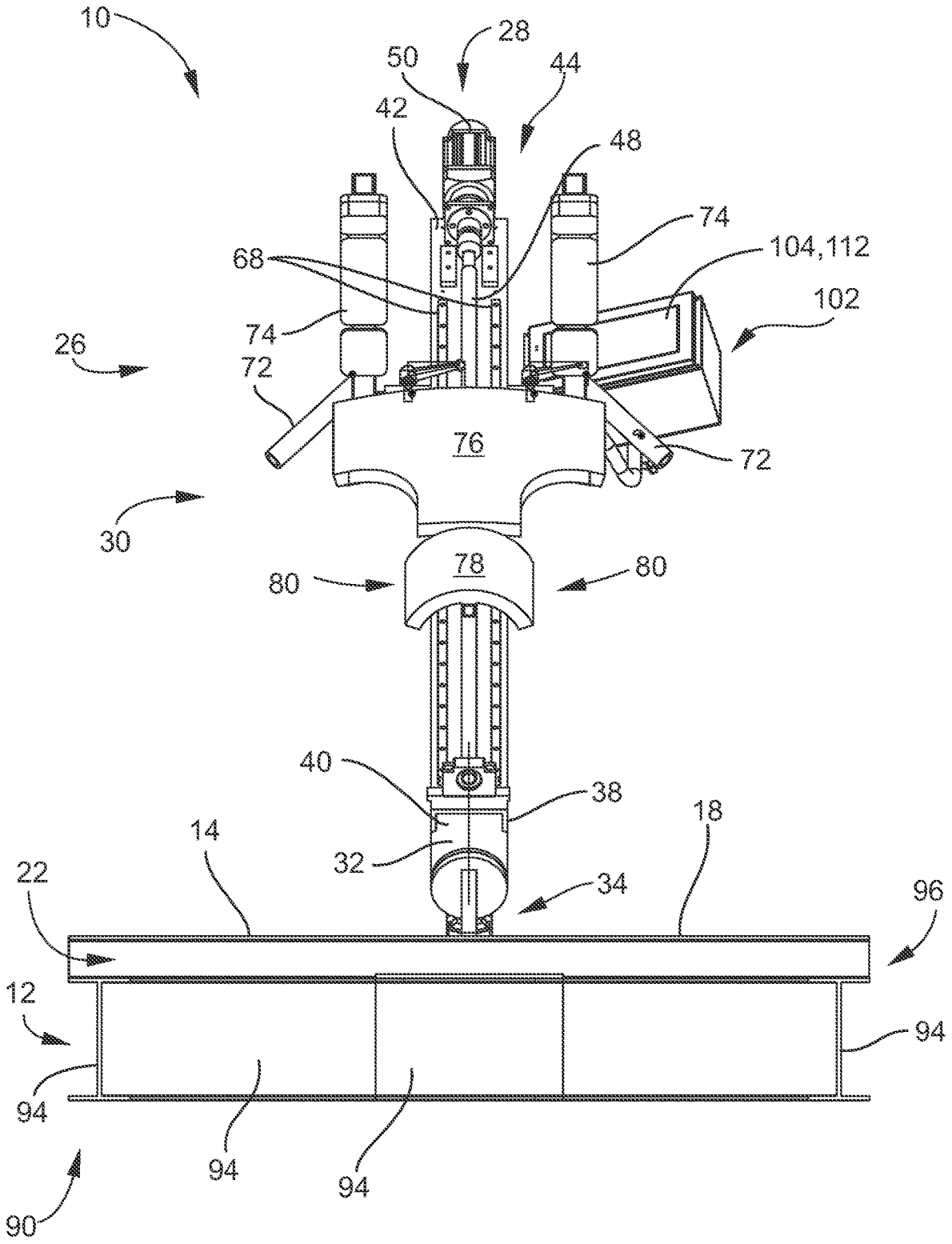
FIG. 8 illustrates front view of the negative tilting squat machine of FIG. 1 in a lowered horizontal angle position.

Curved chest pad 76 may be included on squatting device 30 of squat apparatus 26 in negative tilting squat machine 10. Curved chest pad 76 may be for providing a location for the chest of user U to be positioned against safely and comfortably while facing center post 28 and performing squat movements or the like on negative tilting squat device 10. As such, curved chest pad 76 may be configured to provide support to user U while forcing user U to use core muscles C to stabilize their movement. As shown in FIGS. 7, 9 and 11, curved chest pad 76 may be attached to sub-carriage 66 via curved chest supports 77 which may connect and support curved chest pad 76 during operation.

Curved leg pad 78 may be includes on squatting device 30 of squat apparatus 26 in negative tilting squat machine 10. Curved leg pad 78 may be for providing a safe and comfortable padding around center post 28 for legs L of user U to be positioned against or around while facing center post 28 and performing squat movements or the like on negative tilting squat device 10. As such, curved leg pad 78 may be configured to allow user U to safely and comfortably position their legs L on each side 80 of center post 28. As shown in FIGS. 7, 9 and 11, curved leg pad 78 may be attached to sub-carriage 66 via leg supports 79 which may connect and support curved leg pad 78 during operation.

Linear angle actuator 82 may be included in negative tilting squat machine 10. Linear angle actuator 82 may be for controlling the angle between base 12 and center post 28 with squat apparatus 26, i.e. squat angle 36. Linear angle actuator 82 may be any device or means for controlling the angle between base 12 and center post 28. Linear angle actuator 82 may be configured to adjust squat angle 36 between base 12 and squat apparatus 26 pivotally mounted on base 12. Linear angle actuator 82 may be configured to allow user U to adjust squat angle 36 between base 12 and squat apparatus 26 pivotally mounted on base 12 from vertical angle 84 (see FIGS. 2 and 5A) to horizontal angle 86 (see FIGS. 1, 3-4, 5B, and 6-11), and all various angles or degrees therebetween. Vertical angle 84 may be vertical or 90 degrees, or it may be approximately vertical or approximately 90 degrees. Horizontal angle 86 may be any desired angle less than 90 degrees. In select embodiments, horizontal angle 86 may be approximately 20 degrees from horizontal. In select embodiments, linear angle actuator 82 may be configured to allow user U to adjust squat angle 36 to fixed squat angle 88 prior to exercise movements. In other select embodiments, linear angle actuator 82 may be configured to adjust squat angle 36 freely during exercise movements. This feature may give user U a degree of freedom of motion when performing squat exercises or the like on negative tilting squat machine 10. In other select embodiments, linear angle actuator 82 may be configured to adjust squat angle 36 at set intervals during exercise movements. Linear angle actuator 82 may be controlled with processor 102 via graphical user interface 112 on display 104.

Processor 102 may be included with negative tilting squat machine 10. Processor 102 may be for controlling the various components of negative tilting squat machine 10 and for analyzing use of negative tilting squat machine 10 for providing feedback to user U. Processor 102 may thus be configured to control force 46 provided by resistance actuator 44 and range of motion 60 of squatting device 30, including adjustable stroke 58 with adjustable starting point 62. Display 104 may be configured to provide graphics and force feedback to user U of applied force 54 calculated from load cell 52. In select embodiments, display 104 may include graphical user interface 112 that allows user U to customize their workout. This customization of user U's workout may include, but is clearly not limited thereto: repetition quantity; repetition speed (which can be configured to be varied during the exercise by user U, with up/down speed independently) or duration; constant force or maximum force output configured to vary the speed to keep the force constant, or maintain a constant speed regardless of force applied; stroke length; squat angle or a varying squat angle automatically during the exercise; or any various combinations thereof.

A key feature or advantage of negative tilting squat machine 10 is that it may be designed or configured to allow transmission of force 46 from resistance actuator 44 to user U via the squatting device 30 sliding on center post 28 thereby allowing user U to activate their posterior chain, where operative angle 128 of transmission of force 46 can be adjusted via adjustment of squat angle 36 between base 12 and squat apparatus 26 pivotally mounted on base 12.

Referring now back specifically to FIG. 1, the instant disclosure may be designed to allow user U to control squat angle 36, at which the squat exercise is performed. User U may face curved chest pad 76 of negative tilting squat machine 10 and legs L of user U may wrap around center post 28 with resistance actuator 44. The shape and tilting feature of negative tilting squat machine 10 may allow user U to achieve a down position stance similar to that used on the football field, i.e. football like stance 130. The use of ball screw actuator 48 may allow for consistent force application regardless of the machines angle 36. The ability to perform eccentric exercises on negative tilting squat machine 10 may produce greater gains faster.

In sum, the instant disclosure may be directed toward negative tilting squat machine 10 that may provide a unique squat machine that may allow user U to achieve football like stance 130 during the strength training exercise. This unique positioning may build power through all of the stabilizer muscles to the core muscles C at various angels, like how they will be utilized on the football field, or the like. Using negative tilting squat machine 10's ability to provide eccentric and concentric exercise, user U may increase their strength rapidly compared to only concentric strength training.

One feature of the instant disclosure may be negative tilting squat machine 10 with the main force producing structure mounted to tubular center structure 32, which is mounted to base 12 by single pivot point 34 to allow for angular adjustment.

Another feature of the instant disclosure may be an exercise machine using ball screw 48 type actuator to produce force 46 against user U controlled by velocity.

Another feature of the instant disclosure may be a machine or exercise device using ball screw 48 type actuator that allows for adjustable stroke 58 of machine 10 to match range of motion 60 of user U.

Another feature of the instant disclosure may be linear angle actuator 82 that allows user U to adjust squat angle 36 during exercise, or on the fly to achieve the proper stance from a vertical to a near twenty degree from horizontal stance.

Another feature of the instant disclosure may be tilting foot board 18 that can provide foot support or grip as needed.

Another feature of the instant disclosure may be center post 28 that allows user U to face center post 28 during exercise and place their legs L comfortably protected around resistance actuator 44 such to assume a proper football stance.

Another feature of the instant disclosure may be curved chest pad 76 that user U places their chest on during exercise that provides support, but requires user U to use abdominal and stabilizer muscles (i.e. core muscles C) to maintain posture during the exercise, simulating a more free weight style exercise.

Another feature of the instant disclosure may be shoulder pads 74 that may adjust to the users shoulder S to allow transmission of force 46 from user U to machine 10 and vice versus.

Another feature of the instant disclosure may be set of handles 72 that may adjust to the users grip and height T, that allows the user U to activate the posterior chain more effectively as desired.

Another feature of the instant disclosure may be dual directional load cell 52 directly mounted to the squat apparatus 26 to provide realistic force feedback to user U via graphical user interface 112 on display 104.

Another feature of the instant disclosure may be graphics and forces feedback provided to user U via graphical user interface 112 on display 104, that may encourage user U to increase their output.

Another feature of the instant disclosure may be graphical user interface 112 on display 104 that allows user U to customize the workout by: Repetition quantity, Repetition Speed/Duration (which can be configured to be varied during the exercise by the user independently) or duration, Constant Force/Maximum Force Output (this will vary the speed to keep the force constant, or maintain a constant speed regardless of force applied), Stroke Length, Varying the Angle Automatically During the Exercise (to simulate a real world football scenario)

Another feature of the instant disclosure may be that graphical user interface 112 may be mounted to where user U can easily view feedback and adjust the workout.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A negative tilting squat machine comprising:

a base configured to support the negative tilting squat machine in operation;

a squat apparatus pivotally mounted on the base, the squat apparatus including:

a center post with a squatting device configured to slide on the center post and configured to allow a user to face the center post during exercise;

a resistance actuator mounted on the squat apparatus and configured to produce a force against the squatting device on the center post; and a set of handles, a set of shoulder pads, or a combination thereof attached to the squatting device and configured to slide on the center post and provide the force produced from the resistance actuator against the squatting device to hands of the user gripping the set of handles, shoulders of the user pressing on the set of shoulder pads, or a combination thereof; and a linear angle actuator pivotally mounted on the base and configured to adjust a squat angle between the base and the squat apparatus.

2. The negative tilting squat machine of claim 1, wherein the negative tilting squat machine is configured to allow transmission of the force from the resistance actuator to the user via the squatting device sliding on the center post thereby allowing the user to activate a posterior chain of the user, wherein an operative angle of the transmission of the force can be adjusted via adjustment of the squat angle between the base and the squat apparatus.

3. The negative tilting squat machine of claim 2, wherein the negative tilting squat machine is configured to allow the user to achieve a football stance during use.

4. The negative tilting squat machine of claim 1, wherein the resistance actuator includes a ball screw connected to the squatting device, where the ball screw is powered by an electric motor for moving the squatting device along the center post.

5. The negative tilting squat machine of claim 4, wherein the force against the squatting device is provided by the ball screw powered by the electric motor of the resistance actuator and is controlled by velocity, is configured to match another force, or is configured to match said another force and the velocity in combination.

6. The negative tilting squat machine of claim 4, wherein the ball screw powered by the electric motor includes a load cell attached thereto, the load cell is configured to provide force feedback of an applied force to the user, the load cell is attached to the ball screw and the squatting device via a mounting bracket configured to allow the load cell to directly read the applied force in two directions.

7. The negative tilting squat machine of claim 4, wherein the ball screw powered by the electric motor includes an adjustable stroke configurable to match a range of motion of the user, wherein the adjustable stroke includes an adjustable starting point, wherein said set of handles, said set of shoulder pads, or the combination thereof are configured to adjust to a height of the user.

8. The negative tilting squat machine of claim 1, wherein the center post including a tubular center structure mounted to the base by a single pivot point configured to allow for adjustment of the squat angle between the base and the squat apparatus.

9. The negative tilting squat machine of claim 8, wherein the tubular center structure including a c-channel beam mounted on a front side of the tubular center structure, the c-channel beam is configured to provide a flat mounting surface configured for mounting the squat apparatus to the tubular center structure.

10. The negative tilting squat machine of claim 9, wherein the squatting device of the squat apparatus is mounted to the c-channel beam via a linear bearing assembly mounted to a sub-carriage configured to support the squatting device, the sub-carriage with the linear bearing assembly is configured to slide on a track mounted on the c-channel beam, wherein the linear bearing assembly is configured to remove non-linear forces from the resistance actuator of the squat apparatus.

11. The negative tilting squat machine of claim 1, wherein the linear angle actuator is configured to allow the user to adjust the squat angle between the base and the squat apparatus pivotally mounted on the base from a vertical angle to a horizontal angle, wherein the horizontal angle is approximately twenty degrees from horizontal.

12. The negative tilting squat machine of claim 1, wherein the linear angle actuator is configured to allow the user to adjust the squat angle to a fixed squat angle prior to exercise movements, to adjust the squat angle freely during the exercise movements, or to adjust the squat angle at set intervals during the exercise movements.

13. The negative tilting squat machine of claim 1, wherein the base including a platform configured to support the user standing thereon during use of the negative tilting squat machine.

14. The negative tilting squat machine of claim 13, wherein the platform including a tilting foot board with a hinged front side configured to raise a back side of the tilting foot board, wherein, when the tilting foot board is hinged up to raise the back side, the hinged up tilting foot board provides foot support or grip for the user, wherein the tilting foot board includes a linear foot actuator configured to control the hinging of the tilting foot board.

15. The negative tilting squat machine of claim 13, wherein the base including a substructure beneath the platform for supporting the platform and providing a connection point for a single pivot point of the squat apparatus on the base, the substructure including a plurality of I-beams around a perimeter of the platform.

16. The negative tilting squat machine of claim 15, wherein the base including a protruding I-beam protruding from the platform below the squat apparatus, the protruding I-beam being configured to prevent the negative tilting squat machine from tipping over during operation, said protruding I-beam including a rotatable attachment point for the linear angle actuator configured to adjust the squat angle between the base and the squat apparatus, wherein the squat angle is specifically between the protruding I-beam and the squat apparatus.

17. The negative tilting squat machine of claim 1, wherein the squat apparatus including:

a curved chest pad that is configured to provide support to the user while forcing the user to use core muscles of the user to stabilize movement of the user; and a curved leg pad configured to allow the user to safely and comfortably position legs of the user on each side of the center post.

18. The negative tilting squat machine of claim 1, wherein the set of shoulder pads are configured to rotate, slide laterally, or a combination thereof, to accommodate the shoulders of the user.

19. The negative tilting squat machine of claim 1 further comprising:

a processor configured to control the force provided by the resistance actuator and a range of motion of the squatting device;

a display configured to provide force feedback of an applied force and corresponding graphics to the user, the display includes a graphical user interface that allows the user to customize a workout by:

repetition quantity;

repetition speed or duration;

constant force or maximum force output configured to vary a speed to keep the force constant, or maintain a constant speed regardless of the applied force;

stroke length;

varying the squat angle automatically during the exercise; or combinations thereof.

20. A negative tilting squat machine comprising:

a base configured to support the negative tilting squat machine in operation, the base including a platform configured to support a user standing thereon during use of the negative tilting squat machine, the platform including a tilting foot board with a hinged front side configured to raise a back side of the tilting foot board, wherein when the tilting foot board is hinged up to raise the back side, the tilting foot board provides foot support or grip for the user, wherein the tilting foot board includes a linear foot actuator configured to control the hinging of the tilting foot board of the platform;

a squat apparatus pivotally mounted on the base, the squat apparatus including:

a center post with a squatting device configured to slide on the center post and configured to allow the user to face the center post during exercise movements, the center post including a tubular center structure mounted to the base by a single pivot point configured to allow for adjustment of a squat angle between the base and the squat apparatus, the tubular center structure including a c-channel beam mounted on a front side of the tubular center structure, the c-channel beam is configured to provide a flat mounting surface configured for mounting the squat apparatus to the tubular center structure;

a resistance actuator mounted on the squat apparatus and configured to produce a force against the squatting device on the center post, the resistance actuator includes a ball screw connected to the squatting device, wherein the ball screw is powered by an electric motor for moving the squatting device up and down along the center post, wherein the force against the squatting device is provided by the ball screw powered by the electric motor and is controlled by velocity, is configured to match a another force, or is configured to match a said another force and the velocity in combination;

wherein the ball screw powered by the electric motor includes a load cell attached thereto, the load cell is configured to provide force feedback of an applied force, the load cell is attached to the ball screw and the squatting device via a mounting bracket configured to allow the load cell to directly read the applied force in two directions;

wherein the squatting device of the squat apparatus is mounted to the c-channel beam via a linear bearing assembly mounted to a sub-carriage configured to support the squatting device, the sub-carriage with the linear bearing assembly is configured to slide on a track mounted on the c-channel beam, wherein the linear bearing assembly is configured to remove non-linear forces from the resistance actuator of the squat apparatus;

a set of handles, a set of shoulder pads, or a combination thereof attached to the squatting device configured to slide on the center post and provide the force produced from the resistance actuator against the squatting device to hands of the user gripping the set of handles, shoulders of the user pressing on the set of shoulder pads, or a combination thereof, the set of shoulder pads are configured to rotate, slide laterally, or a combination thereof, to accommodate the shoulders of the user;

wherein the ball screw powered by the electric motor includes an adjustable stroke configurable to match a range of motion of the user, wherein the adjustable stroke includes an adjustable starting point, wherein said set of handles, said set of shoulder pads, or the combination thereof are configured to adjust to a height of the user;

a curved chest pad that is configured to provide support to the user while forcing the user to use core muscles of the user to stabilize movement of the user; and a curved leg pad configured to allow the user to safely and comfortably position legs of the user on each side of the center post; and a linear angle actuator pivotally mounted on the base and configured to adjust the squat angle between the base and the squat apparatus, the linear angle actuator is configured to allow the user to adjust the squat angle between the base and the squat apparatus pivotally mounted on the base from a vertical angle to a horizontal angle, wherein the horizontal angle is approximately twenty degrees from horizontal, the linear angle actuator is configured to allow the user to adjust the squat angle to a fixed squat angle prior to the exercise movements, to adjust the squat angle freely during the exercise movements, or to adjust the squat angle at set intervals during the exercise movements;

wherein the base including a substructure beneath the platform for supporting the platform and providing a connection point for the single pivot point of the squat apparatus on the base, the substructure including a plurality of I-beams around a perimeter of the platform;

wherein the base including a protruding I-beam protruding from the platform below the squat apparatus, the protruding I-beam being configured to prevent the negative tilting squat machine from tipping over during operation, said protruding I-beam including a rotatable attachment point for the linear angle actuator configured to adjust the squat angle between the base and the squat apparatus, wherein the squat angle is specifically between the protruding I-beam and the squat apparatus;

a processor configured to control the force provided by the resistance actuator and a range of motion of the squatting device;

a display configured to provide force feedback of the applied force and corresponding graphics to the user, the display includes a graphical user interface that allows the user to customize a workout by:

a repetition quantity;

a repetition speed or duration;

a constant force or maximum force output configured to vary a speed to keep the force constant, or maintain a constant speed regardless of the applied force;

a stroke length;

the squat angle or a varying squat angle automatically during the exercise movements; or combinations thereof;

wherein the negative tilting squat machine is configured to allow transmission of the force from the resistance actuator to the user via the squatting device sliding on the center post thereby allowing the user to activate a posterior chain of the user, wherein an operative angle of transmission of the force can be adjusted via adjustment of the squat angle between the base and the squat apparatus; and wherein the negative tilting squat machine is configured to allow the user to achieve a football stance during use.

* * * * *